United States Patent [19]

Tudberry

[11] 4,318,579

[45] Mar. 9, 1982

[54] ELECTRICAL CONNECTION SYSTEM INTERLOCK

[75] Inventor: Ronald O. Tudberry, Crewe, England

[73] Assignee: International Computers Limited, London, England

[21] Appl. No.: 134,104

[22] Filed: Mar. 26, 1980

[30] Foreign Application Priority Data

Apr. 17, 1979 [GB] United Kingdom ..... 13273/79

[51] Int. Cl.[3] ..... H01R 13/62

[52] U.S. Cl. ..... 339/74 R

[58] Field of Search ..... 339/74 R, 75 M, 75 MP, 339/176 MP

[56] References Cited

U.S. PATENT DOCUMENTS 3,818,419 6/1974 Crane ..... 339/74 R 4,159,154 6/1979 Arnold ..... 339/74 R 4,243,283 1/1981 McSparran ..... 339/74 R X

*Primary Examiner*—Howard N. Goldberg

*Assistant Examiner*—Frank H. McKenzie, Jr.

*Attorney, Agent, or Firm*—Hane, Roberts, Spiecens & Cohen

[57] ABSTRACT

An electrical connection system for first and second electrical conductor members of the kind in which the first member has an open setting for receiving or releasing the second member and a closed setting for retaining the second in the engaged condition and in which an operating member is provided to open or close the first member, additionally includes an interlock arrangement which prevents operation of the operating member to close the first connector member is only partially engaged and which also stops removal of the second conductor member until the first member has been opened.

4 Claims, 3 Drawing Figures

ELECTRICAL CONNECTION SYSTEM INTERLOCK

BACKGROUND OF THE INVENTION

1. Field of the Invention

This invention relates to electrical interconnection systems.

2. General Description of the Prior Art

Electrical interconnection systems commonly have two connector members each carrying electrical contacts. The two members are fitted together to make electrical connections between the contacts on the two members. One method of fitting the two members together is to make them a push fit. However, it has also been proposed to make it possible to open one member so that the other can be inserted without the need to overcome any substantial resistance, the first member then being closed to grip the second and hold it firmly with the electrical contacts making a good connection. An edge connector for a printed circuit can be constructed to operate in this manner, the edge connector closing to grip an edge region of the printed circuit board carrying contacts connected to the wiring of the board. This construction is especially useful if the printed circuit board is arranged to be inserted parallel to the direction of its edge, that is, along rather than at right angles to the edge connector, because it is difficult under those circumstances to insert the board if the edge connector offers resistance to insertion.

However, there is a danger when one interconnection member is closable that it will be closed before the other is properly inserted, leading to faulty connections. There is also a danger that attempts will be made to separate the members before the closable members have been fully opened, leading to damage to the components.

SUMMARY OF THE INVENTION

Broadly, according to the invention there is provided an electrical interconnection system comprising first and second electrical connection members which are intended to inter-engage with each other for the purposes of electrical connection of which the first connector member has a first operational setting in which it can receive or release the second connector member, and a second operational setting in which the second connector member is retained in the inter-engaged condition, an operating means for enabling selection of the operational setting of the first connector member, and an interlock arrangement including a first and second parts respectively associated with the second connector members and the operating means which first part is so operationally inter-engageable with the second part and with the operating means that, whilst the first and second electrical connector members are not, during a connection operation, correctly positionally oriented with respect to each other, the interlock arrangement parts operationally inter-engage to prevent the operating means from selecting the first operational setting of the first electrical connector member.

Preferably the interlock arrangement is arranged to prevent the first and second electrical connector members from being disengaged whilst the first electrical connector member is in its first operational setting.

Conveniently, the interlock arrangement includes an electrical inter-connection system as claimed in claim 1 or 2 in which the first part of the interlock arrangement includes a movable interlock member displaceable when the first connector member is in its first operational setting, to a first position in which the first connector member cannot be operated to be brought into its second operational setting, the movable interlock member being prevented from being moved out of its first position if the second connector member is partially but not fully positioned for inter-engagement with the first connector member and a second position in which the first connector member may be operated to be changed from its first to second operational settings or vice versa but the second connector member is prevented from being removed from engagement with the first connector member.

Preferably the interlock member in its first position obstructs operation of the first connector member to change it from its first to its second setting while allowing the second connector member to be so positioned relative to the first member to be inter-engageable therewith and in its second position obstructs removal of the second connector member from engagement with the first connector member.

Preferably one of the connector members carries a bar extending parallel to the direction of relative motion of the two connector members while being brought into position for engagement, the interlock member carrying an element which clears the side of the bar when the two connector members are being moved relative to one another and the interlock member is in its first position, and obstructs the end of the bar when the two connector members are retained in engagement and the interlock member is in its second position.

The first connector member may be an edge connector, the second connector member being a body (for example, a printed circuit board) carrying at least one contact on an edge region, and the edge connector being arranged in its first condition to allow insertion of the second connector member and in its second condition to grip the second conductor member so as to retain it in engagement.

The invention also provides a first connector element and an interlock member suitable, with a suitable second member, for forming an interconnection system according to the invention.

BRIEF DESCRIPTION OF THE DRAWINGS

An interconnection system constructed in accordance with the invention will now be described in greater detail by way of example with reference to the accompanying drawings, in which.

DESCRIPTION OF THE PREFERRED EMBODIMENT

Figure 1:
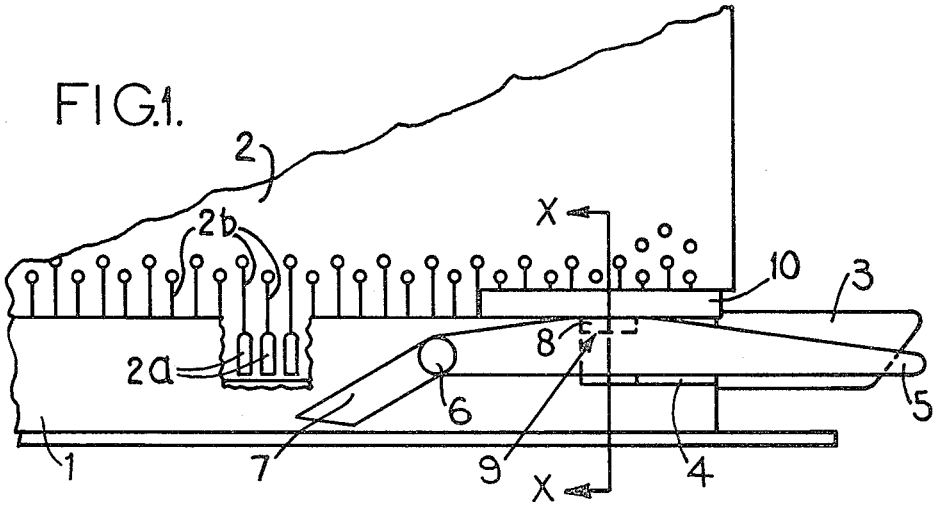
FIGS. 1 and 2 are side views, with parts broken away, of the system at different stages in the process of forming the interconnection.

Referring to the drawings, the interconnection system has two main elements, an edge connector 1 and a printed circuit board 2. An edge region of the board 2 carries contacts *2a* connected to the wiring *2b* of the board. When the edge connector 1 and board 2 are interconnected the edge region of the board 2 is gripped by jaws of the edge connector and contacts (not shown) on the inner faces of the jaws are held under pressure i.e. spring against the contacts *2a* so as electrically to interconnect them. That is the jaws are resiliently loaded towards their open position.

Figure 2:
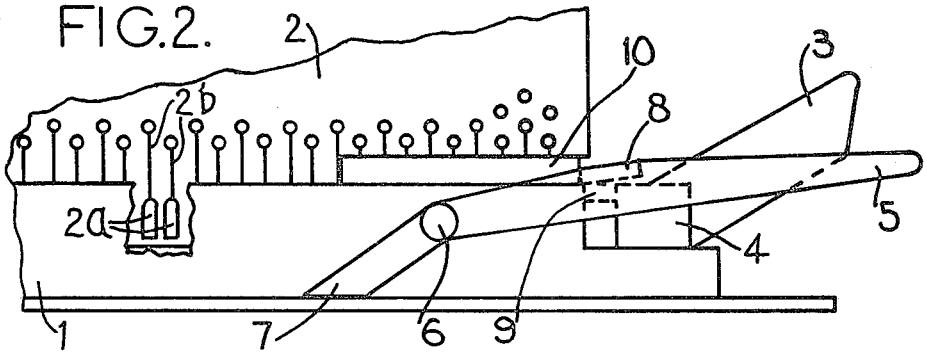

The arrangement is such that the board 2 is inserted in the edge connector 1 by being slid in a direction parallel to the length of the edge connector 1. Such an arrangement may be required, for example, when the board 2 is mounted in a rack system in which it is supported not only by the edge connector 1 but also at the opposite edge region. To allow the board to be inserted the jaws of the edge connector 1 may be opened by a handle 3 which connects with wedge means or cam which in a first setting pushes the jaws open and in a second setting allows the jaws to close. The jaws are in the open condition when the handle is down, as shown in FIG. 1. Raising the handle 3 operates the wedge means or a cam in a block 4 which moves a wedge to close the jaws against spring pressure. When the handle is lifted to the position shown in FIG. 2 the jaws are resiliently loaded to their closed condition. Lowering the handle again withdraws the wedge means or cam and allows the jaws to open under the spring pressure.

If the interconnection system consisted merely of these elements it would be possible to close the jaws before the board 2 was fully inserted. That would lead to incomplete or incorrect connections between the contacts of the edge connector 1 and the board 2. There is also a danger that attempts will be made to remove the board before the jaws have been fully opened, with the risk of damage to the contacts. An interlock lever 5 is provided as a protection against both these dangers.

The interlock lever 5 pivots on a post 6 mounted on the edge connector and has an extension 7 beyond the post 6. It also carries a projection 8 which, when the handle 3 is in the down position, fits into a recess 9 bounded at one end by one face of the block 4 and at the other by the main body of the edge connector 1. A bar 10 is mounted on the face of the printed circuit board 2 that is towards the interlock lever 5, being attached by adhesive over the wiring of the board 2 connected to the contacts *2a*. It is positioned to lie along the top of the edge connector 1 when the board 2 is fully inserted, and extends inward from the rear side edge of the board. The bar 10 cooperates with the interlock lever 5 during operation of the interconnection system in the manner that will now be described.

Figure 3:
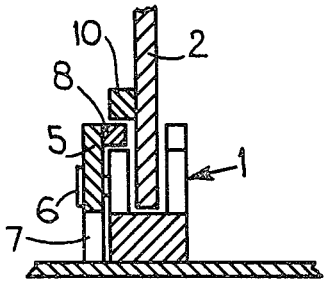
FIG. 3 is a section on the line XX of FIG. 1.

When a board is to be inserted the handle 3 is lowered, opening the jaws of the edge connector 1. The interlock lever 5 is then lowered so that the projection 8 fits into the recess 9. In this position the board 2 may be slid into position, and for the last part of the motion the bar 10 overlies the projection 8. For this part of the motion, therefore, during which the board is not fully inserted, the interlock lever 5 is prevented from being lifted out of the recess 9 and that in turn prevents the handle 3 from being lifted. It is thus impossible to close the jaws of the edge connector. That is the position shown in FIGS. 1 and 3.

It remains impossible to raise the handle 3 until the board 2 has been fully inserted, when the bar 10 clears the recess 9. At this point, with the board correctly placed relative to the edge connector 1, the interlock lever 5 may be lifted, taking the projection 8 out of the recess 9 and allowing the handle 3 to be raised. That causes the jaws to close and grip the board 2, which is now correctly positioned for the contacts on the board and edge connector to mate in the required manner.

The lever 5 may be raised only until the point at which the extension 7 strikes the member on which the edge connector 1 is mounted. When that occurs, the projection 8 bears against the end of the bar 10. When the handle 3 is then lifted to close the jaws the block 4 moves forward and shortens the recess 9, preventing the lever 5 from being lowered. Therefore while the handle 3 is in the lifted position it is impossible to remove the board 2 because the projection 8, bearing on the bar 10, blocks its removal.

When it is desired to remove the board the handle 3 is lowered, allowing the interlock lever 5 to be moved down until the projection 8 sits in the recess 9. The board may now be slid out. However, until the handle 3 is fully down and the jaws fully open the interlock lever 5 cannot be moved down and removal of the board is blocked.

The arrangement described above may be duplicated at the opposite edge of the board. There will therefore be a pair of levers 5 and a pair of handles 3 to operate in inserting and removing the board.

I claim:

1. An electrical connector system including first and second electrical connector elements, the first having an edge region with first contacts, and the second connector element including a slot like opening for receiving the edge region, and having a plurality of second contacts intended for electrical connection with the first contacts upon operational engagement of the edge region within the slot in the second connector element; a first lever means pivoted to the second connector element for adjusting the latter between a first position in which the edge portion can be readily inserted into or removed from the slot without any contact pressure being produced between the first and second contacts and a second position in which a required contact pressure is obtained; and an interlocking means for controlling operation of the first lever and including a second lever pivoted to the second connector element and having a first setting in which it is adapted to interlock with the first lever means to retain it in its first position and an interlock element provided upon the first connector element, so as to be co-operable with the second lever to hold it in said first setting unit until the edge region is correctly operationally positioned within the slot, and such that when said correct position is attained to allow the second lever to be moveable to a second setting in which it releases the interlock with the first lever to permit the latter to be moved to the second position thereof to allow the second connector element to produce the desired contact pressure and also to prevent the second lever from being returned to the first position whilst contact pressure is being exerted.

2. A connector system as claimed in claim 1, in which the slot is open at one end whereby the edge portion enters by said open end and is displaced lengthwise of the slot, and in which the interlock element on the first connector element includes a guide bar or the like extending lengthwise of the slot but spaced therefrom, for co-operation with the second lever.

3. A connector system as claimed in claim 2, in which the interlock element obstructs movement of the second lever from its first setting to its second setting.

4. A connector system as claimed in claim 2, in which the second lever is provided with a projection which is co-operable with the interlock element on the edge portion, and which is additionally co-operable when the second lever is in the second setting, with a locating recess therefor which is produced when the first lever is in its second position, said recess being effectively removed when the first lever is in the first position.

* * * * *